United States Patent [19]

Donnelly et al.

[11] 4,370,125

[45] Jan. 25, 1983

[54] CONTROL SYSTEM FOR BLUE-FLAME OIL BURNER

[75] Inventors: Donald E. Donnelly, Edwardsville, Ill.; Francis J. Maney, Mahwah, N.J.

[73] Assignee: Emerson Electric Co., St. Louis, Mo.

[21] Appl. No.: 192,850

[22] Filed: Oct. 1, 1980

[51] Int. Cl.[3] ..... F23N 50/00

[52] U.S. Cl. ..... 431/66; 431/71; 431/74; 431/79; 340/579; 307/117

[58] Field of Search ..... 431/66, 69, 71, 74, 431/75, 77, 78, 79; 307/112, 116, 117; 340/577, 578, 579; 328/6

[56] References Cited

U.S. PATENT DOCUMENTS

| | | | |
|---|---|---|---|
| 3,732,433 | 5/1973 | Lourigan | 431/74 X |
| 3,767,354 | 10/1973 | Wright | 431/71 X |
| 3,947,219 | 3/1976 | Santo | 431/79 |
| 4,024,412 | 5/1977 | MacAskill | 431/79 X |
| 4,231,732 | 11/1980 | Newport et al. | 431/74 X |
| 4,242,081 | 12/1980 | Donnelly et al. | 431/71 X |
| 4,278,419 | 7/1981 | Bechtel et al. | 431/79 X |

*Primary Examiner*—Samuel Scott

*Assistant Examiner*—Margaret A. Focarino

*Attorney, Agent, or Firm*—Paul A. Becker, Sr.

[57] ABSTRACT

A control system for fluid fuel burners, particularly for blue-flame oil burners, utilizes flame conduction to control energizing of the light emitting portion of an optical coupler. Circuit means including the light responsive portion of the optical coupler is effective, in the presence of a predetermined level of illumination from the light emitting portion which occurs in the absence of a burner flame, to enable flow of a combustible fuel-air mixture and energizing of ignition means, and, in the subsequent absence of the predetermined level of illumination when burner flame exists, to terminate energizing of the ignition means and to enable continued flow of the combustible mixture. The control system further includes means for reducing the rate and level of illumination of the light emitting portion so that it requires a predetermined time period for the light emitting portion to be energized to the predetermined level of illumination. This predetermined time period prevents initial energizing of the system in the event of a false flame indication, and enables uninterrupted system operation in the event of a momentary loss of flame conduction.

7 Claims, 1 Drawing Figure

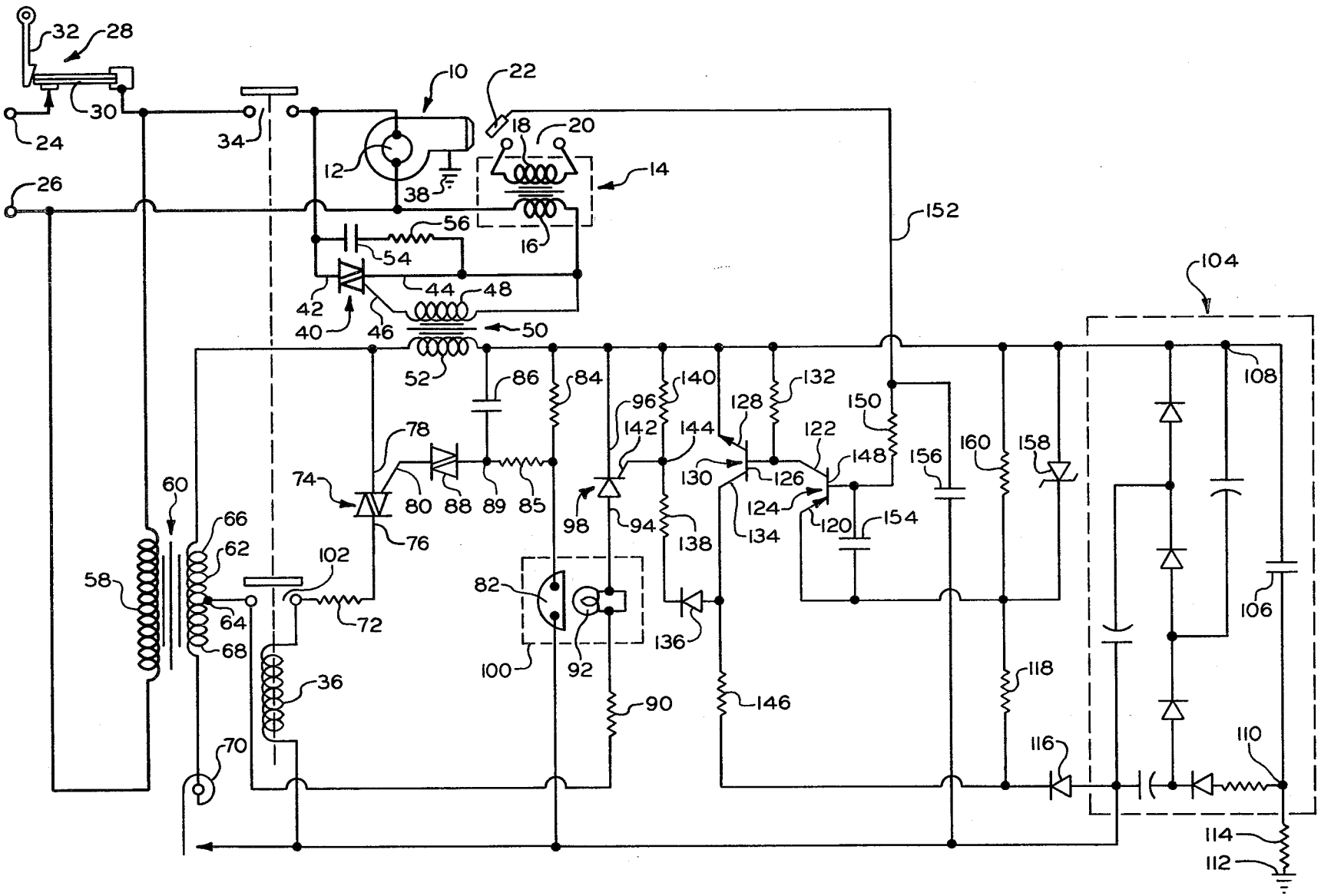
10
12
14
16
18
20
22
24
26
28
30
32
34
36
38
40
42
44
46
48
50
52
54
56
58
60
62
64
66
68
70
72
74
76
78
80
82
84
85
86
88
89
90
92
94
96
98
100
102
104
106
108
110
112
114
116
118
120
122
124
126
128
130
132
134
136
138
140
142
144
146
148
150
152
154
156
158
160

CONTROL SYSTEM FOR BLUE-FLAME OIL BURNER

This invention relates to electrical control systems for fluid fuel burners, and particularly to electrical control systems for blue-flame oil burners.

Control systems for oil burners, both of the conventional type and of the blue-flame type, provide a timed trial ignition period during which ignition of a combustible air-oil mixture is attempted. In such systems, if flame does not appear within the trial ignition period, the system locks out, terminating the flow of the combustible mixture and de-energizing the ignition means. If flame does appear within the trial ignition period, such systems are effective for terminating the trial ignition period and for allowing continued flow of the combustible mixture.

Circuit means for providing the timed trial ignition period includes means responsive to the absence and presence of the flame. In conventional oil burners, a commonly used flame responsive means has been a photoelectric cell, such as a cadmium-sulfide cell, which is responsive to certain wavelengths of the energy radiated from the generally yellowish flame. Another commonly used flame responsive means, on conventional oil burners, has been a temperature sensitive device, such as a bimetal-actuated switch, which is responsive to the heat developed by the flame.

In blue-flame oil burners, the flame is generally blueish and the cadmium-sulfide cell is ineffective for detecting the wavelengths of the energy radiated from the blueish flame. Therefore, in control systems for blue-flame oil burners, flame is generally detected by the above mentioned temperature sensitive device or by some other means such as flame conduction.

The prior art shows blue-flame oil burner control systems utilizing flame conduction. For example, such a system is shown in U.S. Pat. No. 3,767,354. However, such systems are generally quite complex and expensive.

An object of this invention, therefore, is to provide a generally new and improved electrical control system for blue-flame oil burners which utilizes flame conduction and is relatively simple and inexpensive.

A further object of this invention is to provide a control system for blue-flame oil burners wherein a combustible fuel mixture flows and ignition is attempted for a timed trial ignition period; wherein, upon detection of burner flame by a flame probe, the ignition means is de-energized, fuel flow continues, and electrical safety-switch heater means for establishing the timed trial ignition period is de-energized; and wherein circuit means is effective to delay the effects of flame detection so as to ensure safe and reliable operation.

These and other objects and advantages of the present invention will become apparent from the following description when read in connection with the accompanying drawing.

The single FIGURE of the drawing is a schematic illustration of a blue-flame oil burner control system constructed in accordance with the present invention.

DESCRIPTION OF THE PREFERRED EMBODIMENT

The control system of the present invention employs a coupling transformer for controlling ignition, an arrangement disclosed in Application Ser. No. 17,584, filed Mar. 5, 1979, and now U.S. Pat. No. 4,242,081 "OIL BURNER PRIMARY CONTROL FOR INTERRUPTED IGNITION SYSTEM" by Donald E. Donnelly et al., assignors to the assignee of the present invention. Also, the control system of the present invention employs circuitry for flame conduction similar to that disclosed in Application Ser. No. 939,414, filed Sept. 5, 1978, now U.S. Pat. No. 4,231,732 for "GAS BURNER CONTROL SYSTEM" by Harry E. Newport Jr. et al., assignors to the assignee of the present invention.

Referring to the drawing, the system includes an oil burner 10 having an electric motor 12 operative to supply a combustible mixture of fuel and air to burner 10, an ignition transformer 14 having a primary winding 16 and a secondary winding 18, a pair of spark electrodes 20 connected across secondary winding 18 and disposed adjacent burner 10 to ignite the combustible mixture, and a flame probe 22 disposed so as to be impinged by the burner flame. The burner motor 12 is connected across terminals 24 and 26 of a conventional 120 volt alternating current power source in series with a normally closed thermally operated safety switch 28 having a bimetal blade 30 and a pivoted latch 32, and a set of normally open contacts 34 of a relay having a controlling winding 36. Burner 10 is connected to ground potential at 38. The ignition transformer primary winding 16 is connected in series with a controlled solid state ignition switch comprising a triac 40 having main terminals 42 and 44 and a gate terminal 46, and the series-connected circuit of winding 16 and triac 40 is connected in parallel with burner motor 12.

The secondary winding 48 of a miniature coupling transformer 50 is connected between the gate 46 and main terminal 44 of triac 40. When the primary winding 52 of coupling transformer 50 is sufficiently energized, the induced voltage and accompanying current in the secondary winding 48 cause triac 40 to be gated on, as will be hereinafter described. A capacitor 54 and a resistor 56 are series connected across main terminals 42 and 44 of triac 40 to provide initial hold-in current for triac 40.

The primary winding 58 of a voltage step-down transformer 60 is connected across power source terminals 24 and 26 through safety switch 28. The secondary winding 62 of transformer 60 has a center tap at 64 which divides the secondary winding 62 of approximately 28 volts into an upper portion 66 of approximately 18 volts and a lower portion 68 of approximately 10 volts.

Relay winding 36 is connected across the entire secondary winding 62 in series with a space thermostat 70, a resistance heater 72 associated with safety switch 28, and a controlled solid state switch comprising a triac 74 having main terminals 76 and 78 and a gate 80.

Also connected in series across secondary winding 62 are thermostat 70, a photoconductive cell 82, a resistor 84, and primary winding 52 of coupling transformer 50. A resistor 85 and a capacitor 86 are connected in series with each other and in parallel with resistor 84. A voltage breakdown device comprising a diac 88 is connected between the gate 80 of triac 74 and a point 89 between resistor 85 and capacitor 86.

Connected in series across upper portion 66 of secondary winding 62 are a resistor 90, an incandescent tungsten filament lamp 92, the anode 94 and cathode 96 of a controlled solid state switch 98 comprising an SCR, and primary winding 52 of coupling transformer 50.

Incandescent lamp 92 and photoconductive cell 82 comprises an optical coupler, lamp 92 being mounted adjacent cell 82 within a casing 100. Cell 82, a variable resistor whose resistance value depends on the level of illumination to which it is exposed, has a very high electrical resistance in the ambient darkness within casing 100. When the filament lamp 92 is energized, cell 82 responds to the light emitted from the lamp 92 and decreases in resistance.

As will be hereinafter described, during a normal operating cycle, SCR 98 is conductive in the absence of a burner flame, and non-conductive in the presence of burner flame. Therefore, filament lamp 92 is energized in the absence of burner flame, and de-energized in the presence thereof. When SCR 98 initially becomes conductive, filament lamp 92 becomes energized. Resistor 90, in series with lamp 92, reduces the voltage across lamp 92, lowering the rate and level of illumination of lamp 92. For purposes to be hereinafter described, this lower level of illumination results in lamp 92 having to be energized approximately 150 to 250 milliseconds before light responsive cell 82 is at a desired resistance value. It is noted that, while employment of resistor 90 is preferred, the lower rate and level of illumination could also be effected by providing secondary winding 62 with another voltage tap to provide a voltage lower than that provided by tap 64, or by utilizing a higher voltage lamp.

Cell 82 and resistor 84 form a voltage divider, and series connected resistor 85 and capacitor 86 are in parallel with resistor 84. In the absence of flame, when lamp 92 is sufficiently illuminated, the resistance of cell 82 becomes sufficiently low so that capacitor 86 can charge to the firing voltage of diac 88. In the presence of flame, when lamp 92 is de-energized, the resistance of cell 82 is sufficiently high to prevent capacitor 86 from charging to the firing voltage of diac 88.

In addition to controlling contacts 34, relay winding 36 also controls another set of normally open contacts 102 which, when closed, provide a hold-in circuit for relay winding 36 through contacts 102, the lower portion 68 of secondary winding 62, and thermostat 70. The closing of contacts 102 also completes a circuit across the upper portion 66 of secondary winding 62 through contacts 102, safety switch resistance heater 72, and triac 74.

Connected across secondary winding 62 of transformer 60 in series with thermostat 70 and primary winding 52 of coupling transformer 50 is a conventional voltage quadrupler indicated generally at 104. Quadrupler 104 is effective, after a few cycles of the alternating current power source, to produce a voltage potential of approximately 130 volts across a capacitor 106 therein, with a point 108 on one side of capacitor 106 being positive with respect to a point 110 on the other side thereof. Point 110 is connected to ground potential at 112 through a resistor 114. Quadrupler 104 ensures that a potential of approximately 70 to 80 volts will exist between probe 22 and burner 10 to ensure flame conduction. It is noted that quadrupler 104 or similar voltage multiplying means is required due to the low voltage, approximately 28 volts, at secondary winding 62.

Also connected across secondary winding 62 of transformer 60, in series, are thermostat 70, a rectifier or diode 116, a resistor 118, the emitter 120 and collector 122 of a PNP darlington transistor 124, the base 126 and emitter 128 of an NPN transistor 130, and primary winding 52 of coupling transformer 50. A bias resistor 132 is connected between the base 126 and emitter 128 of transistor 130.

Connected in parallel with the collector 134 and emitter 128 of transistor 130 is a series connected circuit comprising a rectifier 136, a resistor 138, and a resistor 140. The control electrode 142 of SCR 98 is connected to a point 144 between resistors 138 and 140. A resistor 146 is connected between the anode side of rectifier 136 and the cathode side of rectifier 116.

The base 148 of transistor 124 is connected through a high impedance resistor 150 and a lead 152 to probe 22. A filter capacitor 154 is connected in parallel with the emitter 120 and base 148 of transistor 124. A capacitor 156 is connected between the anode side of rectifier 116 and lead 152. Capacitor 156 is effective to filter out any transient signals due to induced voltage on lead 152 which would tend to turn on transistor 124 or keep it on once it was conducting.

A reference voltage for transistor 124 is established by a voltage regulator or zener diode 158 and a resistor 160 connected in parallel between point 108 in quadrupler 104 and emitter 120 of transistor 124.

In the absence of a burner flame, the impedance between probe 22 and burner 10 is extremely high. When a flame appears, the impedance between probe 22 and burner 10 decreases, through the flame, enabling transistor 124 to be biased on, the circuit being: from point 108 in quadrupler 104, through parallel connected voltage regulator 158 and resistor 160, emitter 120 and base 148 of transistor 124, resistor 150, lead 152, probe 22, the burner flame, burner 10, ground 38, ground 112, resistor 114, and point 110 in quadrupler 104. With transistor 124 biased on, current from secondary winding 62 is effective to turn on transistor 130, the circuit being: from secondary winding 62 of transformer 60, thermostat 70, rectifier 116, resistor 118, emitter 120 and collector 122 of transistor 124, base 126 and emitter 128 of transistor 130, and primary winding 52 of coupling transformer 50 back to secondary winding 62 of transformer 60.

When transistor 130 is on, current flows from secondary winding 62 of transformer 60 through thermostat 70, rectifier 116, resistor 146, collector 134 and emitter 128 of transistor 130, and primary winding 52 of coupling transformer 50 back to secondary winding 62 of transformer 60. With transistor 130 on, the voltage thereacross is low but sufficient to cause diode 136 to conduct. However, resistors 138 and 140 limit the current flow through diode 136 to a sufficiently low value so as to prevent SCR 98 from being gated on. Thus, in the presence of burner flame, SCR 98 is off.

In the absence of burner flame, transistor 124 is off. With transistor 124 off, transistor 130 is also off. With transistor 130 off, sufficient current can then flow, when thermostat 70 is closed, through rectifier 136 and resistors 138 and 140. Under these conditions SCR 98 is gated on. Thus, in the absence of flame, SCR 98 is on.

OPERATION

When thermostat 70 is open, there is no voltage or current at the gate 142 of SCR 98 so that SCR 98 is off. With SCR 98 off, filament lamp 92 is de-energized.

Under normal operating conditions, closing of thermostat 70 upon a call for burner operation effects the energizing of voltage quadrupler 104. After a few cycles of the applied alternating current from transformer secondary winding 62, capacitor 106 in quadrupler 104 is charged to approximately 130 volts. Concurrently, SCR 98 is gated on. With SCR 98 on, filament lamp 92 begins to illuminate, the rate and level of illumination being limited by the value of resistor 90. Closing of thermostat 70 also effects the connection of thermostat 70, photoconductive cell 82, resistor 84, resistor 85, capacitor 86, and primary winding 52 of coupling transformer 50 across secondary winding 62 of transformer 60.

After approximately 150 to 250 milliseconds, the level of illumination of lamp 92 is such that the resistance of cell 82 has decreased to a sufficiently low value to enable capacitor 86 to charge to the diac firing voltage, between 6 and 10 volts, whereby diac 88 becomes conductive. With diac 88 conducting, capacitor 86 discharges through diac 88 and through the gate 80 and main terminal 78 of triac 74, turning on triac 74, and through primary winding 52 of coupling transformer 50. Resistor 85 is of sufficiently high resistance to prevent discharging of capacitor 86 through resistor 84. When diac 88 conducts, the current flow therethrough includes the discharge current of capacitor 86 and a current flow from secondary winding 62 through photoconductive cell 82 and resistor 85. Diac 88 conducts until the current flow therethrough falls below its hold-in value, at which time diac 88 again becomes non-conductive.

The current flow through diac 88 from secondary winding 62 is preferably limited by the resistive values of cell 82 and resistor 85 to a value insufficient to provide the hold-in current required to maintain diac 88 conductive. Thus, diac 88 becomes non-conductive when the discharge current from capacitor 86 is insufficient to provide the hold-in current. It should be noted that even if the current flow from secondary winding 62 were slightly more than the diac hold-in value, diac 88 is assured of being turned off due to the inherent oscillating between capacitor 86 and primary winding 52 of coupling transformer 50.

With diac 88 again non-conductive, capacitor 86 again charges and again fires the diac 88. The impedance values in the charging and discharging circuits of capacitor 86 are such that diac 88 is turned on and off a number of times, approximately five to ten times, during each half cycle of the alternating current sine wave generated by secondary winding 62 of transformer 60. The resulting increase and decrease of current through the primary winding 52 of coupling transformer 50, occurring each time diac 88 is turned on and off, is quite rapid and causes a plurality of voltage pulses to be induced therein. These pulses induce the same number of pulses in the secondary winding 48 of coupling transformer 50 for a purpose to be hereinafter described.

When triac 74 is gated on, a circuit is completed across the entire secondary winding 62 of transformer 60 through thermostat 70, relay winding 36, safety switch resistance heater 72, and triac 74, causing both sets of normally open relay contacts 34 and 102 to be closed. Once triac 74 is gated on, it remains on until the current flow therethrough drops below its hold-in value. When that occurs, triac 74 becomes non-conductive until it is again gated on. Because of the previously described manner of operation of diac 88, triac 74 is cyclically gated on early in each half cycle of the alternating current sine wave being applied thereto. Therefore, triac 74 is essentially on all the time, as long as there is no burner flame.

The closing of relay contacts 102 connects relay winding 36 across the lower portion 68 of secondary winding 62 through thermostat 70 and contacts 102 to provide a hold-in circuit for relay winding 36. This hold-in circuit prevents de-energizing of the relay winding 36 when triac 74 is no longer gated on.

The closing of relay contacts 102 also connects safety switch resistance heater 72 and triac 74 across the upper portion 66 of secondary winding 58. Safety switch resistance heater 72 begins to heat to provide a timed trial ignition period.

The closing of relay contacts 34 connects the burner motor 12 across the power source terminals 24 and 26 through safety switch 28 and relay contacts 32 to initiate flow of fuel and air to burner 10.

In the manner previously described, a plurality of pulses are induced in the secondary winding 48 of coupling transformer 50. Each of these pulses is of sufficient voltage and generates sufficient current to gate triac 40 on. Therefore, when relay contacts 34 initially close, triac 40 becomes conductive. With triac 40 conducting, ignition transformer 14 is energized and sparking occurs at electrodes 20 to ignite the fuel and air mixture. These conditions persist until either combustion of the fuel and air mixture occurs or until the safety switch 28 opens.

To enable triac 40 to turn on, it is necessary that there be a sufficient hold-in current flow through triac 40 when it is gated on. Due to the highly inductive properties of the primary winding 16 of ignition transformer 14, the current from power source terminals 24 and 26 does not begin to flow through triac 40 immediately when triac 40 is gated on. To provide an immediate current flow through triac 40, capacitor 54 and resistor 56 are utilized. The values of capacitor 54 and resistor 56 are such that they provide triac 40 with sufficient hold-in current immediately upon the triac 40 being gated on and until sufficient hold-in current flows from the power source terminals 24 and 26. It should be noted that capacitor 54 and resistor 56 would not be required should an electrical resistance igniter be used, since there would be no delay in current flow with a purely resistive igniter.

By providing a plurality of gating pulses to triac 40, the effect of a phase difference between a single gating pulse and the sine wave alternating current appearing at the main terminals 42 and 44 of triac 40 is negated. A plurality of pulses ensures that a gating pulse will occur relatively early in each half of the sine wave of the current appearing at main terminals 42 and 44 of triac 40 so that triac 40 will conduct during essentially all of the sine wave, as long as gating pulses continue to be generated. This condition ensures sufficient energizing of ignition transformer 14. This condition also ensures sufficient energizing of other igniters, such as electrical resistance igniters, which would effect different voltage-current phase angles at triac 40.

Under normal conditions, combustion occurs within the timed trial ignition period. When a burner flame appears, the reduced impedance through the flame enables transistor 124 to be biased on. Transistor 124 being on enables transistor 130 to become conductive. When transistor 130 is on, it shunts the gating of SCR 98 so that SCR 98 becomes non-conductive.

With SCR 98 off, lamp 92 is de-energized, causing cell 82 to increase in resistance. When the resistance of cell 82 becomes sufficiently high, capacitor 86 can no longer charge to the voltage necessary to fire diac 88 so that diac 88 is off. With diac 88 off, triac 74 is also off so that the safety switch resistance heater 72 is de-energized.

With diac 88 off and capacitor 86 being prevented from charging to the diac firing voltage, pulses no longer appear in primary winding 52 of coupling transformer 50. The resistance of cell 82 and resistor 84 and the resistance of resistor 146, resistor 146 being connected in parallel with series-connected cell 82 and resistor 84, and the resistances of resistors 118 and 160, resistors 118 and 160 being series-connected with each other and in parallel with cell 82 and resistor 84, are sufficiently greater than the impedance of primary winding 52 so that an extremely small value of voltage appears across primary winding 52. This small value is insufficient to enable secondary winding 48 to effect gating of triac 40. Thus, when burner flame appears, triac 40 is no longer gated on so that the ignition transformer 14 is de-energized. Since relay winding 36 remains energized through its hold-in circuit, contacts 34 remain closed and burner motor 12 remains energized. Under normal operation, these conditions exist until thermostat 70 opens to de-energize relay winding 36.

If combustion fails to occur, the bimetal blade 30 of safety switch 28 will warp upwardly due to heating of the safety switch resistance heater 72, which heating occurs when triac 70 is conducting, and effect the opening of the safety switch 28. When safety switch 28 opens, the trial ignition period is terminated and the entire system is de-energized. Latch 32 in safety switch 28 prevents automatic reclosing of safety switch 28 as the safety switch resistance heater 72 cools, thus requiring a manual unlatching or resetting of the safety switch 28 to enable attempting another burner operation.

If during normal burner operation the electrical power fails, the relay winding 36 is de-energized, causing the burner motor 12 to be de-energized. Upon resumption of electrical power, the burner motor 12 and ignition transformer 14 are controlled in the same manner as previously described for a normal operation.

If during normal burner operation the flame is extinguished for any reason, current immediately ceases to flow through the emitter 120 and base 148 of transistor 124, causing transistor 124 to turn off. With transistor 124 off, transistor 130 can no longer be biased on so it turns off. With transistor 130 off, SCR 98 is gated on and lamp 92 illuminates. Due to resistor 90, which reduces the voltage available across lamp 92 and thus retards the rate and level of illumination thereof, it takes approximately 150 to 250 milliseconds after SCR 98 is gated on, for the resistance of cell 82 to become sufficiently low to enable capacitor 86 to charge to the firing voltage of diac 88. When diac 88 fires, burner motor 12 remains energized, triac 74 becomes conductive to enable the safety switch resistance heater 72 to be energized, pulses are induced in secondary winding 48 of coupling transformer 50, triac 40 is gated on, and reignition is attempted.

In the event of a false indication of flame caused, for example, by moisture build-up on probe 22 which would reduce the impedance between probe 22 and burner 10, the above described 150 to 250 millisecond time period prevents unsafe operation of the system. Specifically, when thermostat 70 closes, SCR 98 turns on immediately. If the impedance between probe 22 and burner 10 is sufficiently low due to, for example, moisture build-up on probe 22, transistors 124 and 130 are biased on, transistor 130 being effective to shunt the gating of SCR 98 and thus cause SCR 98 to shut off. However, primarily due to capacitor 154 and to the time required to charge capacitor 106 in quadrupler 104, it takes approximately 20 to 30 milliseconds for transistors 124 and 130 to turn on. The 150 to 250 millisecond time period assures that during the time that SCR 98 is on and transistor 130 is off, relay winding 36 is prevented from being energized. It is noted that if relay winding 36 were to be energized under these conditions, it would be held in through its contacts 102, and the subsequent non-conduction of SCR 98 due to conduction of transistor 130 would not enable winding 36 to be de-energized, thus resulting in an unsafe condition wherein burner motor 12 is energized and the ignition transformer 14 and safety switch resistance heater 72 are de-energized.

Another feature of the above described 150 to 250 millisecond time period is that it ensures desirable system operation in the event of a brief time period, less than 150 milliseconds, during which flame exists but flame conduction does not. Specifically, it has been observed that, in a normal burner cycle, there sometimes are time periods of flame conduction loss. This conduction loss appears to be caused by flame flicker or pulsation. It appears that this loss occurs every few seconds and lasts for a period of time less than 150 milliseconds. Because of the 150 to 250 millisecond delay, such flame conduction loss has no effect on the system operation. It is noted that if the 150 to 250 millisecond time delay were not provided, such flame conduction loss would cause repetitive momentary energizing of the safety switch resistance heater 72 and ignition transformer 14. Such energizing of the heater 72 would eventually cause the safety switch 28 to open, shutting down the system; such energizing of the ignition transformer 14 would most likely reduce its service life.

While a preferred embodiment of the present invention has been illustrated in detail in the drawings and foregoing description, it will be recognized that many changes and modifications will occur to those skilled in the art. It is therefore intended, by the appended claims, to cover any such changes and modifications as fall within the true spirit and scope of the invention.

We claim:

1. In a burner control system, a photoconductive cell;

an incandescent filament lamp coupled to said cell and effective, when energized, to cause said cell to decrease in electrical resistance from a high value to a low value;

circuit means, including said cell, for controlling operation of a burner and an ignition means in response to said low resistance value and said high resistance value of said cell;

a flame probe disposed in close proximity to said burner;

a controlled solid-state switch connected in series with said lamp;

gating circuit means for said switch, including said probe, for rendering said switch non-conductive in the presence of a current flow between said probe and said burner through a burner flame thus effecting de-energizing of said lamp to effect said high resistance value of said cell, and for rendering said switch conductive in the absence of said current flow thus enabling energizing of said lamp to effect said low resistance value of said cell; and means for reducing the rate and level of illumination of said lamp.

2. The control system claimed in claim 1 wherein said means for reducing the rate and level of illumination of said lamp comprises a resistor connected in series with said lamp.

3. In a burner control system, a controlled solid state switch;

an optical coupling device having a light emitting portion and a light responsive resistive portion, said light emitting portion being connected in series with said switch;

flame conduction circuit means connected to a control electrode of said switch and effective for enabling conduction of said switch in the absence of a current flow through a burner flame and for preventing conduction thereof in the presence of said current flow;

circuit means for energizing said light emitting portion of said optical coupling device when said switch is conductive;

circuit means, including said resistive portion of said optical coupling device, responsive to a predetermined level of illumination of said light emitting portion of said optical coupling device for effecting energizing of a burner motor which supplies a combustible fuel-air mixture, for effecting energizing of an ignition means which ignites said mixture, and for providing a timed trial ignition period during which said mixture flows and said ignition means is energized, said circuit means for energizing said light emitting portion of said optical coupling device including means for retarding energizing thereof to said predetermined level of illumination; and circuit means for maintaining energizing of said burner motor when said switch is subsequently non-conductive.

4. In an electrically operated control system for controlling operation of a fuel burner and an ignition device, a first controlled solid state switch;

a flame probe disposed in close proximity to the burner;

gating circuit means for said first switch, including said probe, for enabling conduction of said first switch in the absence of a burner flame and for preventing conduction thereof in the presence of said burner flame;

light emitting means connected in series with said first switch and effective to be energized to a predetermined level of illumination when said first switch is conductive;

variable resistor means, responsive to light from said light emitting means, having a low resistance value when said light emitting means is energized to said predetermined level of illumination and a high resistance value when said light emitting means is de-energized;

a second controlled solid state switch;

gating circuit means for said second switch, including said variable resistor means, effective for enabling conduction of said second switch when said variable resistor means is at said low resistance value and for preventing conduction thereof when said variable resistor means is at said high resistance value, whereby said second switch is conductive in said absence of said burner flame and non-conductive in said presence of said burner flame;

circuit means, including said second switch when conductive, for enabling flow of fuel to said burner and energizing of the ignition device; and circuit means, independent of said second switch, for enabling continued flow of fuel when said second switch is non-conductive.

5. The control system claimed in claim 4 wherein said light emitting means is an incandescent lamp and said variable resistor means is a photoconductive cell.

6. The control system claimed in claim 5 including circuit means for reducing the voltage across said lamp so as to require a time period of approximately 150 to 250 milliseconds for said lamp to be energized to said predetermined level of illumination.

7. In an electrically operated control system for controlling operation of a fuel burner and an ignition device, a voltage step-down transformer having a primary winding connected across an alternating current power source and a secondary winding;

a first controlled solid state switch;

light emitting means;

circuit means, including said first switch and said light emitting means, connected across said secondary winding;

gating circuit means for controlling conduction of said first switch;

voltage multiplying means connected across said secondary winding;

a flame probe disposed in close proximity to the burner;

solid state switching means biased into conduction by said voltage multiplying means through said flame probe, a burner flame when it exists, and said burner, and effective for shunting said gating circuit means for said first switch when said burner flame exists and for enabling said gating circuit means to be energized in the absence of said burner flame to effect conduction of said first switch;

light responsive means connected across said secondary winding upon a call for heat and coupled with said light emitting means;

a second controlled solid state switch;

a relay having an electrical winding and two sets of normally open contacts;

timing circuit means including a set of normally closed contacts and a resistance heater;

circuit connections connecting said relay winding, said resistance heater, and said second switch across said secondary winding upon said call for heat for effecting energizing of said relay winding and closing of said two sets of relay contacts;

circuit connections connecting a burner motor across said power source through said timing circuit contacts and one of said two sets of relay contacts;

a third controlled solid state switch;

circuit connections connecting the ignition device across said power source through said timing circuit contacts, said one of said two sets of relay contacts, and said third switch;

circuit connections, including the other of said two sets of relay contacts, connecting said resistance heater across said secondary winding through said second switch;

circuit connections, including said other of said two sets of relay contacts and independent of said second switch, connecting said relay winding across said secondary winding as long as said call for heat exists and said timing circuit contacts are closed;

gating circuit means for said second switch, including said light responsive means, effective for gating said second switch into conduction when said light emitting means is sufficiently energized to effect a predetermined electrical resistance value of said light responsive means, and for preventing said gating when said light emitting means is not sufficiently energized to effect said predetermined electrical resistance value; and gating circuit means for said third switch including a first portion connected in circuit with said second switch and energized when said second switch is conductive, and a second portion coupled to said first portion so as to be energized thereby and connected to a control electrode of said third switch to control conduction thereof.

* * * * *